US005244353A

United States Patent [19]

Paquet et al.

[11] Patent Number: 5,244,353

[45] Date of Patent: Sep. 14, 1993

[54] GAS PUMPING INSTALLATION HAVING MEANS FOR REGULATING ITS PUMPING SPEED

[75] Inventors: Jean-Marc Paquet; Luc Mathieu, both of Annecy le Vieux, France

[73] Assignee: Alcatel Cit, Paris, France

[21] Appl. No.: 956,243

[22] Filed: Oct. 5, 1992

[30] Foreign Application Priority Data

Oct. 7, 1991 [FR] France ..... 91 12310

[51] Int. Cl.[5] ..... F04B 49/02

[52] U.S. Cl. ..... 417/205; 417/253; 417/286; 417/295

[58] Field of Search ..... 417/205, 253, 286, 287, 417/295

[56] References Cited

U.S. PATENT DOCUMENTS

| | | | |
|---|---|---|---|
| 1,948,907 | 2/1934 | Egli | 417/295 |
| 2,935,242 | 3/1960 | Lorenz | 417/205 |
| 2,951,633 | 9/1960 | Fites | 417/295 X |
| 3,680,980 | 8/1972 | Bart | 417/253 |
| 3,922,110 | 11/1975 | Huse . | |
| 4,580,950 | 4/1986 | Sumikawa et al. | 417/295 |
| 4,596,518 | 6/1986 | Sumikawa . | |

FOREIGN PATENT DOCUMENTS

| | | |
|---|---|---|
| 0206539 | 12/1986 | European Pat. Off. . |
| 0343914 | 11/1989 | European Pat. Off. . |
| 2020371 | 7/1970 | France . |
| 470589 | 5/1969 | Switzerland . |

OTHER PUBLICATIONS

Patent Abstracts of Japan (M-796) Feb. 10, 1989 & JP-A-63 263 282 (Toyota Autom Loom Works) Oct. 31, 1988.

*Primary Examiner*—Richard E. Gluck

*Attorney, Agent, or Firm*—Sughrue, Mion, Zinn, Macpeak & Seas

[57] ABSTRACT

A Roots-type machine is connected to an enclosure to be evacuated via a suction inlet portion, and to a primary pump via a delivery outlet portion. A bellows is disposed transversely in the inlet portion, one end of the bellows being fixed in gastight manner in the wall, and the other end being closed and movable, so that the bellows forms a regulating member for regulating the gas-flow sectional area in the inlet portion. The outside face of the movable end of the bellows is subjected to the pressure in the inlet portion, and the inside face of the movable end is subjected to the pressure in the delivery outlet portion via a rod passing through the wall, and via a channel. The invention applies to Roots-type machines, in particular for automatically regulating the pumping speed so as to match it to the flow-rate of the corresponding primary pump.

5 Claims, 2 Drawing Sheets

GAS PUMPING INSTALLATION HAVING MEANS FOR REGULATING ITS PUMPING SPEED

The present invention relates to a gas pumping installation comprising a Roots-type machine and a primary pump connected in series, a suction inlet portion of the Roots machine being connected to an enclosure to be evacuated.

BACKGROUND OF THE INVENTION

Roots-type machines in current use are limited as regards their flow-rates when working at high pressures, in particular due to their being coupled to primary pumps having flow-rates that are lower at high suction pressures, and also due to the limited power of their motors.

The use of starter systems servo-controlled to the working pressure of the primary pump and to the pressure difference between the suction portion and the delivery portion of the Roots machine has already been described. Such devices are costly and complicated, and are therefore unreliable. Moreover, servo-controlled systems require pressure to be tapped from the pumping line, and this suffers from major drawbacks, in particular for reasons of safety in the event that corrosive gases are being pumped.

An object of the invention is to provide an installation of the type mentioned in the introduction and enabling the pumping speed of the Roots machine to be automatically regulated by simple, compact, cheap, effective, and safe means.

SUMMARY OF THE INVENTION

To this end, the invention provides an installation which, in the inlet portion of the Roots machine, includes a regulating device for regulating the gas-flow sectional area as a function of the pressure difference between the respective pressures in said inlet portion and in a delivery outlet portion of the Roots machine, so as to match the flow-rate of the machine to that of the primary pump.

More particularly, the regulating device preferably includes a bellows of elongate overall shape and disposed transversely relative to the flow of gas in the inlet portion of the Roots machine, the cross-sectional area of the bellows being at least equal to the inside cross sectional area of said inlet portion, a first end of the bellows being fixed in gastight manner in a wall of said inlet portion, the second end of the bellows being closed and movable in the longitudinal direction of the bellows so as to change the gas-flow sectional area. The outside face of the second end is subjected to the pressure in the inlet portion of the Roots machine, and the inside face of the second end is subjected to the pressure in the outlet portion, either directly or via a mechanical member, via an opening in the wall supporting said first end and via a channel connecting the opening to the delivery outlet portion of the Roots machine. A spring, such as a helical traction spring, may be provided to act on said movable end of the bellows, so as to compensate for the stiffness thereof and so as to maintain it in a position of equilibrium when said pressure difference is substantially zero.

The bellows used is preferably cylindrical in overall shape and has a diameter larger than the largest dimension of the inside sectional area of the inlet portion of the Roots machine, said bellows being disposed in a transverse cylindrical housing formed in said inlet portion, so that the bellows is guided when it is being deformed and allows gas to flow only through the space between the walls of said housing and the outside surface of the bellows. The mechanical member transmitting the pressure through said wall of the inlet portion of the Roots machine may be a rod which has one of its ends fixed to the movable end of the bellows, and which passes through said opening in the wall of said inlet portion.

BRIEF DESCRIPTION OF THE DRAWING

An embodiment of the invention is described by way of example with reference to the accompanying drawing, in which.

DETAILED DESCRIPTION

Figure 1:
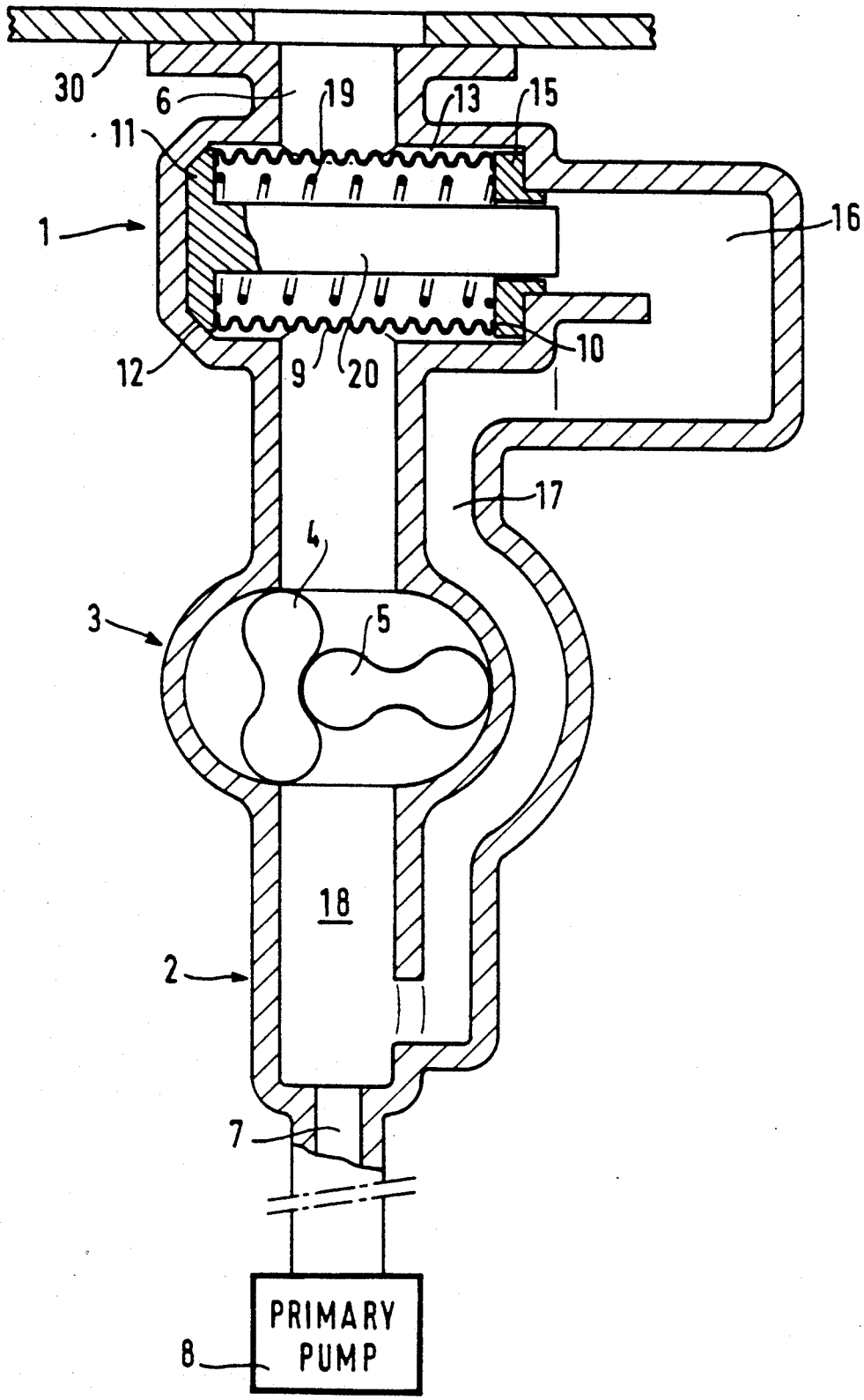
FIG. 1 is a diagrammatic view in longitudinal section of a Roots machine, including a regulating device for regulating the gas-flow sectional area in the inlet portion of the machine.

The Roots machine shown diagrammatically in FIG. 1 includes an inlet portion designated by the overall reference 1, and an outlet portion referenced 2, between which portions a pumping structure 3 having rotary pistons 4, 5 is disposed. The opening 6 of the inlet portion of the machine is designed to be made to communicate with an enclosure 30 to be evacuated. The delivery outlet orifice 7 of the Roots machine is connected to a primary pump diagrammatically represented by a block 8.

A bellows 9 which is cylindrical in overall shape is disposed transversely in the inlet portion 1 of the Roots machine. One end 10 of the bellows is fixed in gastight manner in the wall of the inlet portion, and the other end 11 can be engaged in a recessed portion 12 in the wall of said inlet portion when the bellows is in its position of maximum expansion. When the bellows is in its retracted position, as shown in FIG. 2, the bellows is folded back in a recessed portion 13 of the wall, which portion is diametrically opposite from the portion 12.

Figure 3:
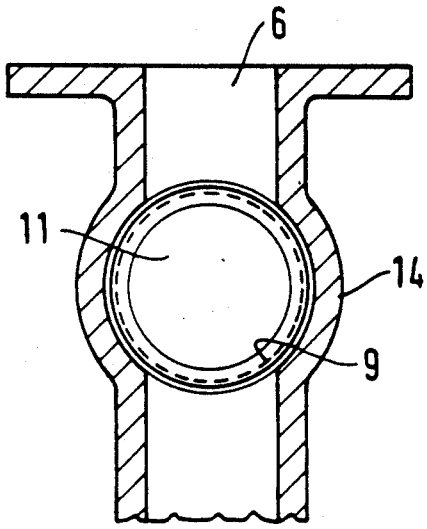
FIG. 3 shows a section on the plane III—III in FIG. 2.

The cross-section in FIG. 3 shows that the inlet portion of the machine forms an essentially cylindrical housing 14 in which the bellows is guided when it is being moved. The diameter of the housing is slightly larger than the outside diameter of the bellows, and substantially larger than the diameter of the inlet opening 6, so that, when the bellows is in its position of maximum expansion, the gas sucked in can pass only through the space between the outside surface of the bellows and the surface of the housing 14, as well as into the space between portions 11 and 12, where applicable.

Figure 2:
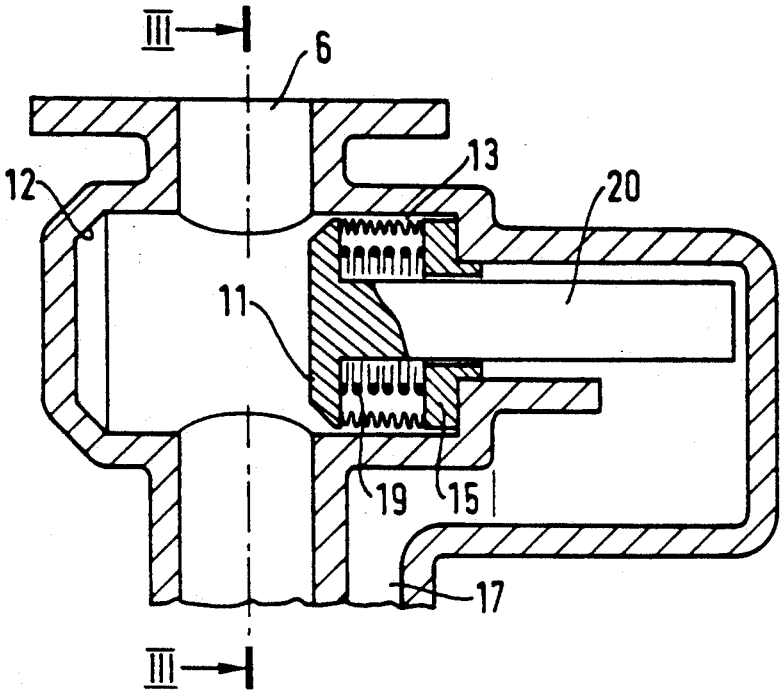
FIG. 2 is a view in axial section of the inlet portion of the Roots machine, showing the open position of the regulating device.

As shown in FIGS. 1 and 2, the bellows is equipped with an actuating rod 20 passing through a fixing portion 15 and penetrating into a chamber 16 which is connected via a channel 17 to the volume 18 of the delivery outlet portion of the machine. The bellows 9 is therefore subjected to the pressure difference between the respective pressures in the inlet portion and in the outlet portion of the Roots machine. A helical traction spring 19 may be provided inside the bellows 9 to compensate for the stiffness thereof, and to maintain it in a position of equilibrium when said pressure difference is substantially zero.

The above-described installation operates as follows.

When the installation is started up, the Roots machine and the primary pump start to operate simultaneously, and the bellows is open and in the position shown in FIG. 2. Given that the flow-rate of the Roots machine is higher than that of the primary pump, the pressure in the chamber 18 and, therefore, in the chamber 16, becomes higher than the pressure in the inlet portion of the machine, and the bellows closes. As a result, the flow-rate of the Roots machine is reduced and the position of the bellows becomes stable when the flow-rate of the Roots machine is compatible with that of the primary pump, the bellows being partially open so as to allow only the quantity of gas corresponding to the steady state to pass.

In the event of sudden variations in gas pressure at the inlet of the Roots machine, as a result of gas being inserted into the enclosure, the pressure in the chamber 18 rises rapidly due to the fact that the flow-rate of the Roots machine is higher than the flow-rate of the primary pump. As a result, the bellows are expanded up to a maximum position (where applicable) in which the gas can only pass around the bellows, in the fluting thereon. By lowering the inlet pressure of the Roots machine, it is possible to return to the above-described stable operating conditions.

The stiffness of the helical spring is chosen so as to compensate for and preferably to be slightly greater than the stiffness of the bellows itself, so that, at rest, the bellows returns to its position shown in FIG. 2.

The above-described regulating device is particularly simple and requires no additional monitoring device or actuating device. Since the channel 17 serves only to put the chamber 18 and the chamber 16 into communication with each other, and therefore does not have a gas flow-rate, the cross-sectional area of the channel can be relatively small, and this makes it possible for the Roots machine to be more compact than a by-pass machine having the same pumping flow-rate. The flow-rate of the Roots machine can be matched to the maximum flow-rate of the primary pump by calibrating the stiffness and the bias of the spring 19.

A particular advantage lies in the fact that the inlet portion is never fully closed off, and the operation of the Roots machine is not interrupted, so that the gas passing through the fluting on the bellows makes it possible to avoid deposition and adhesion of solid particles contained in the gas. Moreover, it is apparent from the above, that gas is not recycled from the chamber 18 to the inlet portion of the Roots device, and this avoids pollution of the enclosure to be evacuated. When corrosive products are being pumped out, the bellows is subjected to corrosion only at low pressure, which corrosion is not very severe. In the event that the bellows breaks, the overall installation remains gastight, so that the pumped gases are not a danger to the operator.

The present invention thus achieves considerable advantages over the conventional installations of the type mentioned in the introduction.

We claim:

1. A gas pumping installation comprising a Roots-type machine and a primary pump connected in series, a suction inlet portion of the Roots machine being connected to an enclosure to be evacuated, wherein said inlet portion of the Roots machine includes a regulating device for regulating the gas-flow sectional area as a function of the pressure difference between the respective pressures in said inlet portion and in a delivery outlet portion of the Roots machine, said regulating device includes a bellows of elongate overall shape and disposed transversely relative to the flow of gas in the inlet portion of the Roots machine, the cross-sectional area of the bellows is at least equal to the inside cross-sectional area of said inlet portion, a first end of the bellows being fixed in gastight manner in a wall of said inlet portion, the second end of the bellows being closed and movable in the longitudinal direction of the bellows so as to change the gas-flow sectional area, an outside face of the second end being subjected to the pressure in the inlet portion of the Roots machine, and an inside face of the second end being subjected to the pressure in the outlet portion, via an opening in the wall supporting said first end and via a channel connecting the opening to the delivery outlet portion of the Roots machine.

2. An installation according to claim 1, wherein a spring is provided to act on said movable end of the bellows, so as to compensate for the stiffness thereof and so as to maintain it in a position of equilibrium when said pressure difference is substantially zero.

3. An installation according to claim 2, wherein said spring is a helical traction spring.

4. An installation according to claim 1, wherein said bellows is cylindrical in overall shape and has a diameter larger than the largest dimension of the inside sectional area of the inlet portion of the Roots machine, said bellows being disposed in a transverse cylindrical housing formed in said inlet portion, so that the bellows is guided when it is being deformed and allows gas to flow only through the space between the walls of said housing and the outside surface of the bellows.

5. An installation according to claim 1, wherein said mechanical member is a rod which has one of its ends fixed to the movable end of the bellows, and which passes through said opening in the wall of the inlet portion of the Roots machine.

* * * * *